US008631512B2

(12) United States Patent
Stachler et al.

(10) Patent No.: US 8,631,512 B2
(45) Date of Patent: Jan. 21, 2014

(54) EYE PROTECTORS

(75) Inventors: Thomas H. Stachler, Dayton, OH (US); William L. Grilliot, West Milton, OH (US); Gary Cunagin, Tipp City, OH (US)

(73) Assignee: Honeywell International Inc., Morristown, NJ (US)

( * ) Notice: Subject to any disclaimer, the term of this patent is extended or adjusted under 35 U.S.C. 154(b) by 510 days.

(21) Appl. No.: 12/397,770

(22) Filed: Mar. 4, 2009

(65) Prior Publication Data

US 2010/0223714 A1 Sep. 9, 2010

(51) Int. Cl.
*A61F 9/00* (2006.01)

(52) U.S. Cl.
USPC ..... 2/10; 2/15

(58) Field of Classification Search
USPC ..... 2/431, 7, 8.1, 8.2, 422, 424, 15, 10, 12, 2/13, 426, 427, 438, 439, 453, 454, 9, 5; 351/155, 47, 48, 57, 58
See application file for complete search history.

(56) References Cited

U.S. PATENT DOCUMENTS 2,998,610 A * 9/1961 Spero ..... 2/13
3,383,155 A 5/1968 Bourke
4,304,005 A * 12/1981 Danley, Sr. ..... 2/10
5,412,812 A * 5/1995 Gatchalian ..... 2/10
5,533,208 A * 7/1996 Tonoyan et al. ..... 2/10
5,669,071 A * 9/1997 Vu ..... 2/10
6,948,812 B2 * 9/2005 Wichner ..... 351/155
2007/0261155 A1 * 11/2007 Tabacchi ..... 2/439
2009/0307816 A1 12/2009 Stachler
2009/0307817 A1 12/2009 Stachler
2009/0307818 A1 12/2009 Stachler

* cited by examiner

*Primary Examiner* — Khoa Huynh
*Assistant Examiner* — Andrew W Collins
(74) *Attorney, Agent, or Firm* — Wood, Phillips, Katz, Clark & Mortimer

(57) ABSTRACT

An eye protector (16) is provided for mounting to a protective helmet (10) of the type worn by a firefighter or other emergency worker. The protective helmet (10) has a brim (14), and the eye protector (16) includes a bracket (20) mounted to the brim (14), an eye shield (18) movable between a storage position extending along the brim (14) and a usage position extending downward from the brim (14) to shield the eye of a wearer, a hinge (22) to connect the eye shield (18) to the mount bracket (20) for movement between the storage and usage positions, a spring (36) engaged with the eye shield (18) and the mount bracket (20) to resist movement of the eye shield (18) from the storage position and from the usage position, and at least one torsion member (38,50) engaged with the eye shield (18) at a location spaced from the spring (36). The at least one torsion member (38,50) applies a force to the eye shield (18) that urges the eye shield (18) toward the brim (14) in the storage position.

17 Claims, 4 Drawing Sheets

EYE PROTECTORS

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention pertains to eye protectors for use with a helmet for a firefighter or other emergency rescue worker.

BACKGROUND OF THE INVENTION

Commonly, a helmet for a firefighter or for an industrial, chemical, or emergency rescue worker has a crown and a brim, which projects forwardly from the crown and which may project in other directions from the crown. Often, the helmet is equipped with a pair of eye shields, one for each eye of a wearer, and each of the pair of eye shields is adapted to be manually moved between a storage position and a usage position. In the usage position, but not in the storage position, the eye shield projects downwardly so as to shield a given eye of a wearer against sparks, liquids, particles, and other objects striking the front of the eye shield.

An example of an eye shield, as described in the preceding paragraph, is disclosed in U.S. Pat. No. 3,383,155 to Lester T. Bourke. As disclosed in U.S. Pat. No. 3,383,155, the disclosure of which is incorporated herein by reference, each of the pair of eye shields is mounted to a helmet, beneath a brim projecting forwardly from a crown of the helmet, and each of the pair of eye shields is adapted to be manually flipped between the storage and usage positions and is stable in either of the storage and usage positions. Similar eye shields are available commercially from various sources including Morning Pride Manufacturing, L.L.C. of Dayton, Ohio. While these shields have performed well for their intended purpose, there is always room for improvement.

The high temperatures often experienced by rescue workers is one challenge faced by such eye shields and can affect the eye shields in both the storage and usage positions. In this regard, in some situations it is desirable that the eye shields not interfere with the vision of a rescue worker when placed in the storage position while experiencing elevated temperatures.

SUMMARY OF THE INVENTION

In accordance with one feature of the invention, an eye protector mountable to a protective helmet is provided for use by a firefighter or other emergency worker. The protective helmet has a brim, and the eye protector includes a mount bracket mounted to the brim, an eye shield movable between a storage position extending along the brim and a usage position extending downward from the brim to shield the eye of a wearer, a hinge to connect the eye shield to the mount bracket for movement between the storage and usage positions, a spring engaged with the eye shield and the mount bracket to resist movement of the eye shield from the storage position and from the usage position, and at least one torsion member engaged with the eye shield at a location spaced from the spring. The at least one torsion member applies a force to the eye shield that urges the eye shield toward the brim in the storage position.

As one feature, the spring is a cantilevered spring extending from a spring bracket fixed to the eye shield.

According to one feature, the mount bracket includes a spring engaging boss, the cantilevered spring engaged with the boss with the eye shield in both the usage position and the storage position to resist movement of the eye shield from the positions.

In one feature, the eye protector further includes a spring bracket fixed to the eye shield by a mount base of the spring bracket, and the at least one torsion member includes a unitary part of the spring bracket extending from the mount base of the spring bracket to a distal end.

According to one feature, the mount base defines a plane and the distal end is twisted relative to the plane in an unrestrained state and aligned with the plane in a restrained state with the spring bracket mounted to the eye shield.

As one feature, the hinge defines a pivot axis for the eye shield and the unitary part extends from the mount base parallel to the pivot axis.

In one feature, the spring is a unitary part of the spring bracket and extends perpendicular to the pivot axis.

According to one feature, the at least one torsion member further includes a helical torsion spring engaged between the eye shield and the mount bracket at a location spaced from the spring and the distal end.

In one feature, the at least one torsion member is a helical torsion spring engaged between the eye shield and the mount bracket.

As one feature, the helical torsion spring is mounted on a pin extending from the hinge.

In accordance with one feature of the invention, an eye protector mountable to a protective helmet is provided for use by a firefighter or other emergency worker. The protective helmet has a brim, and the eye protector includes a mount bracket mounted to the brim, an eye shield movable between a storage position extending along the brim and a usage position extending downward from the brim to shield the eye of a wearer, a hinge to connect the eye shield to the mount bracket for movement between the storage and usage positions; and a spring bracket fixed to the eye shield. The spring bracket includes a spring engaged with the mount bracket to resist movement of the eye shield from the storage position and from the usage position, and a torsion member engaged with the eye shield at a location spaced from the spring, the torsion member applying a force to the eye shield that urges the eye shield toward the brim in the storage position.

In one feature, the torsion member is a unitary part of the spring bracket extending from a mount base of the spring bracket to a distal end.

According to one feature, the hinge defines a pivot axis for the eye shield and the torsion member extends from the mount base parallel to the pivot axis.

In one feature, the eye protector further includes another torsion member engaged between the eye shield and the mount bracket at a location spaced from the spring bracket to apply a force to the eye shield that urges the eye shield toward the brim in the storage position.

In accordance with one feature of the invention, an eye protector mountable to a protective helmet is provided for use by a firefighter or other emergency worker. The protective helmet having a brim, the eye protector includes a mount bracket mounted to the brim, an eye shield movable between a storage position extending along the brim and a usage position extending downward from the brim to shield the eye of a wearer, a hinge to connect the eye shield to the mount bracket for movement between the storage and usage positions, a spring engaged with the eye shield and the mount bracket to resist movement of the eye shield from the storage position and from the usage position, and a torsion member engaged with the eye shield at a location spaced from the spring. The torsion member includes a helical torsion spring applying a force to the eye shield that urges the eye shield toward the brim in the storage position.

As one feature, the helical torsion spring includes a first leg engaged with the eye shield and a second leg engaged with the mount bracket to transmit torque between the eye shield and the bracket.

In one feature, the eye protector includes another torsion member engaged between the eye shield and the mount bracket at a location between the springs to apply a force to the eye shield that urges the eye shield toward the brim in the storage position.

Other objects, features, and advantages of the invention will become apparent from a review of the entire specification, including the appended claims and drawings.

DETAILED DESCRIPTION OF THE PREFERRED EMBODIMENT

Figure 1:
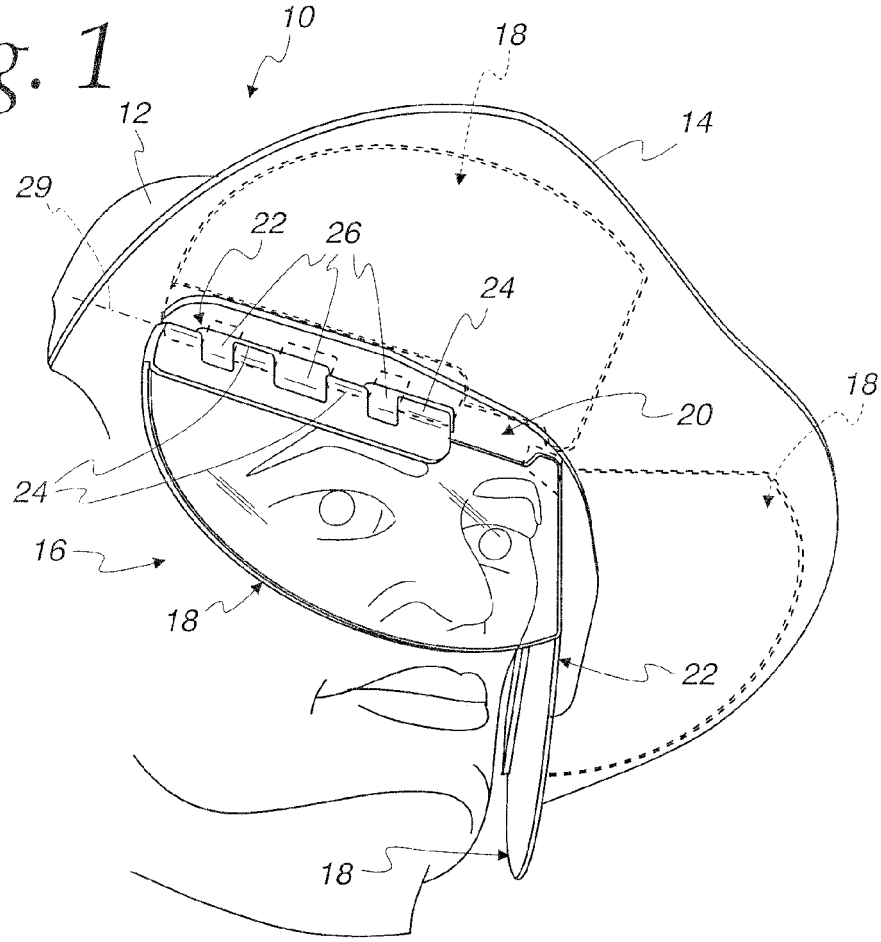
FIG. 1 is a fragmentary, perspective view looking upward toward the front of a helmet equipped with an eye protector embodying the invention.

As shown in FIG. 1, a protective helmet 10 of the type worn by a firefighter or other emergency worker has a crown 12 and a brim 14 that projects forwardly and laterally from the lower part of the crown 12. An eye protector 16 is provided on the helmet 10 in the form of a pair of transparent eye shields 18 that are mounted to the underside of the brim 14 by a mount bracket 20 for manual movement between a storage position and a usage position. The shields 18 are shown in the usage position in FIG. 1, with each shield 18 extending downward from the brim 14 to shield the eyes of a wearer against sparks, liquids, particles, and other such objects which will strike the front of the shields 18 rather than the eyes of a wearer. In the storage position, each of the shields 18 project forwardly along and beneath the brim 14, as shown in phantom in FIG. 1.

Figure 2:
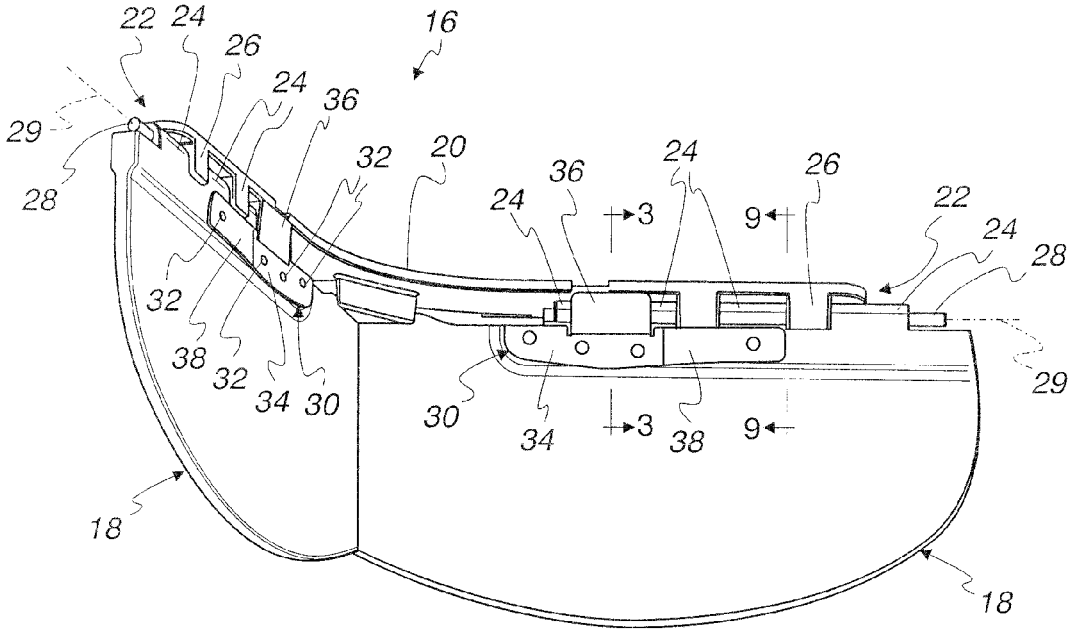
FIG. 2 is a perspective view from below and to the rear of one embodiment of the eye protector of FIG. 1, with eye shields of the eye protector being shown in a usage position.

As shown generally at 22 in FIG. 2, a hinge 22 is provided to pivotably connect each eye shield 18 to the bracket 20 for movement between the storage and usage positions. In the illustrated embodiment, each hinge 22 is defined by a plurality of journal bosses 24 and 26 provided on the corresponding eye shield 18 and the mount bracket 20, respectively, with each of the bosses 24 and 26 having a cylindrical journal opening that receive a hinge pin 28 extending along a hinge axis 29. In this regard, while a preferred form is shown, in some applications it may be desirable to utilize other suitable types of hinge connections, some examples of which are shown in previously discussed U.S. Pat. No. 3,383,155 and also in commonly owned U.S. patent application Ser. Nos. 12/157,483, 12/157,485, and 12/157,539, all filed Jun. 11, 2008, naming Thomas H. Stachler et al as inventors and entitled "Eye Protectors", the entire disclosures of which is incorporated herein by reference.

Figure 3:
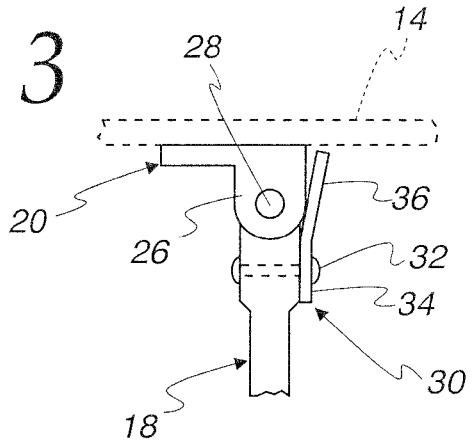
FIG. 3 is a somewhat enlarged view taken from line 3-3 in FIG. 2 and showing a brim of the helmet in phantom.
Figure 4:
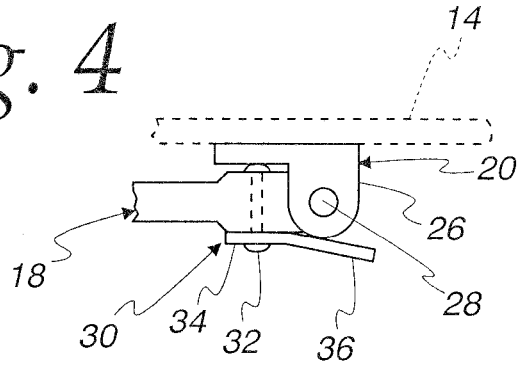
FIG. 4 is a view similar to FIG. 3, but showing the eye shield in a storage position.
Figure 5:
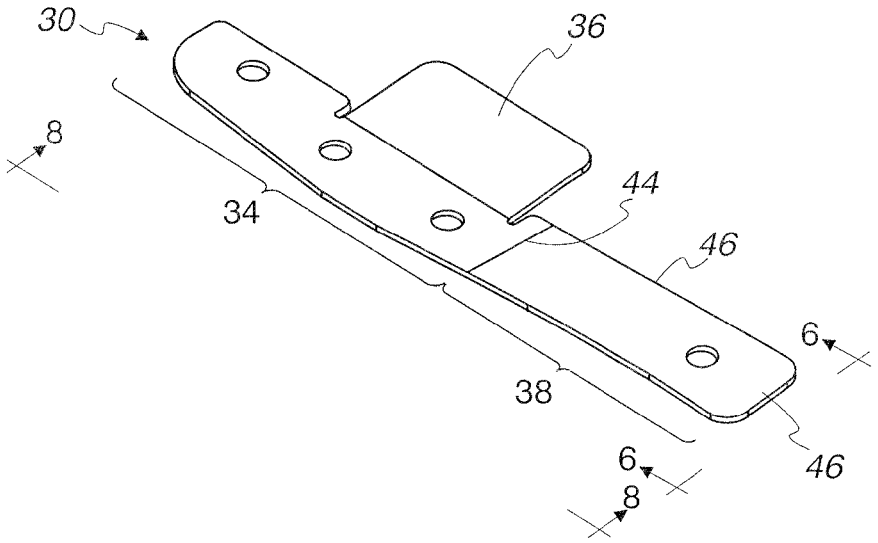
FIG. 5 is a perspective view of a spring bracket of the eye protector of FIGS. 1-4.

With reference to FIG. 2, it can be seen that the eye protector 16 further includes a pair of spring brackets 30, with one of the spring brackets 30 affixed to one of the eye shields 18 and the other spring bracket 30 affixed to the other eye shield 18. Suitable fasteners, such as rivets 32, are used to secure each bracket 30 to its corresponding eye shield 18. Preferably, the spring bracket 30 is a unitary component having a planar mount base portion 34, with a cantilevered spring 36 and a torsion member 38 extending from the mount base 34. The spring 36 extends from the mount base 34 perpendicular to the hinge axis 29 and is engaged with one of bosses 26 of the mount bracket 20 to resist movement of the eye shield 18 from the usage position, as shown in FIG. 3, and also engages the boss 26 to resist movement of the eye shield 18 from the storage position, as shown in FIG. 4. As best seen in FIG. 2, the torsion member 38 extends from the base 34 parallel to the hinge axis 29, and engages the corresponding eye shield 18 over the length of the torsion member 38. As will be explained in more detail below, the torsion member 38 applies a force to the eye shield 18 that urges the eye shield 18 toward the brim 14 with the eye shield 18 in the storage position. While any suitable construction and material can be used, preferably the spring bracket 30 is formed from a stamped piece of sheet metal, preferably a spring steel.

Figure 6:
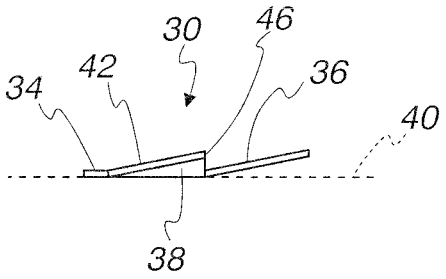
FIG. 6 is a view taken from line 6-6 in FIG. 5.
Figure 7:
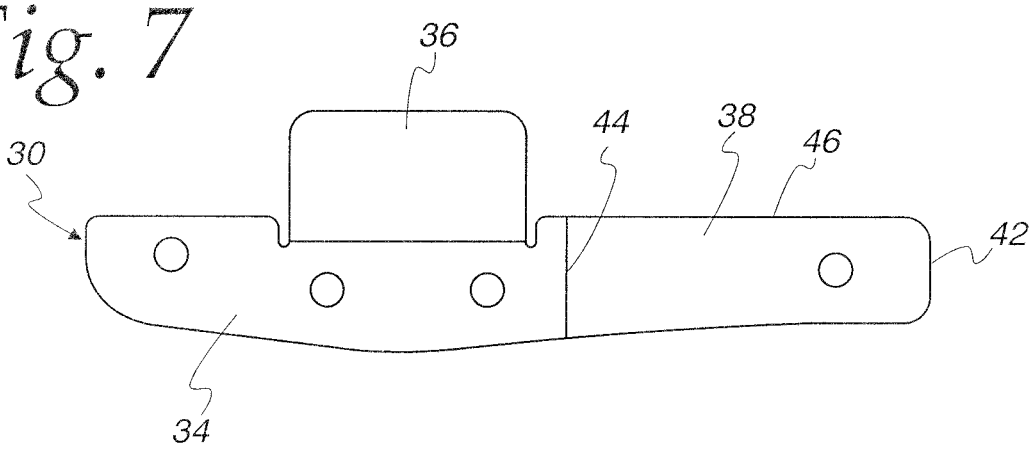
FIG. 7 is a plan view of the spring bracket of FIG. 5.
Figure 8:
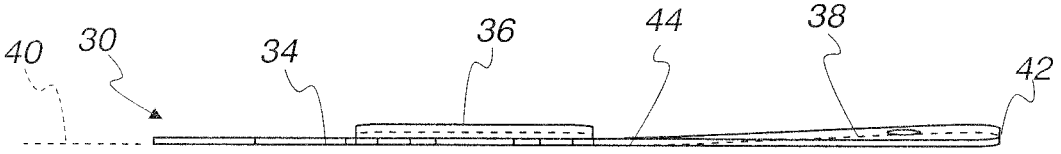
FIG. 8 is a view taken from line 8-8 in FIG. 5.
Figure 9:
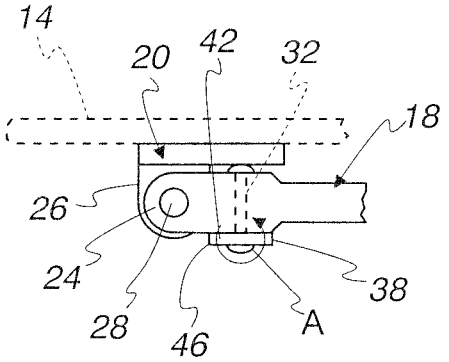
FIG. 9 is a somewhat enlarged view taken from line 9-9 in FIG. 2 and showing the eye shield of the eye protector in the storage position.

As best seen in FIGS. 5-8, in an unrestrained state, the mount base 34 is preferably planar and defines a plane 40 for the bracket 30. As best seen in FIG. 6, the spring 36 is also preferably planar and can either be canted relative to the plane 40 in the unrestrained state, as shown, or can be parallel (not shown) to the plane 40 in the unrestrained state depending upon the requirements of each particular application, including the desired force required to move the corresponding eye shield 18 from either the storage position or the usage position. A distal end 42 of the torsion member 38 is canted or twisted relative to the plane 40 in an unrestrained state, as best seen in FIG. 6, but aligned with the plane 40 in a restrained state with the spring bracket 30 mounted to the eye shield 18, as best seen in FIG. 9. As best seen in FIG. 8, this twist extends over the length of the torsion member 38 with the greatest amount of twist being at the distal end 42 and the least amount of twist being at the junction 44 between the torsion member 38 and the mount base 34. It will be appreciated that by forcing the distal end 42 of the torsion member 38 to align with the plane 40 when mounting the spring bracket 30 to the eye shield 18, a reaction force is transmitted through the corresponding eye shield 18 to deform the torsion member 38 into alignment. It is this reaction force (shown by arrow "A" in FIG. 9) that urges the eye shield 18 towards the brim 14 in the stored position and, more particularly, urges portions of the eye shield 18 that are remote from the spring 36 towards the brim 14 in the storage position. It will be appreciated that, depending upon the requirements of each particular application, the amount of twist desired for the distal end 42 will be highly dependent upon the specific requirements of each application, and in general, for a given material thickness of the spring bracket 30, the greater the twist in the unrestrained state, the greater the force "A" will be. It will also be appreciate that while FIGS. 3-9 illustrate one of the spring brackets 30, the other spring bracket 30 is a "mirror" image, with the twist of the torsion member 38 urging the longitudinal edge 46 of the member 38 closest to the hinge axis 29 away from the corresponding eye shield 18 in the unrestrained condition.

Figure 10:
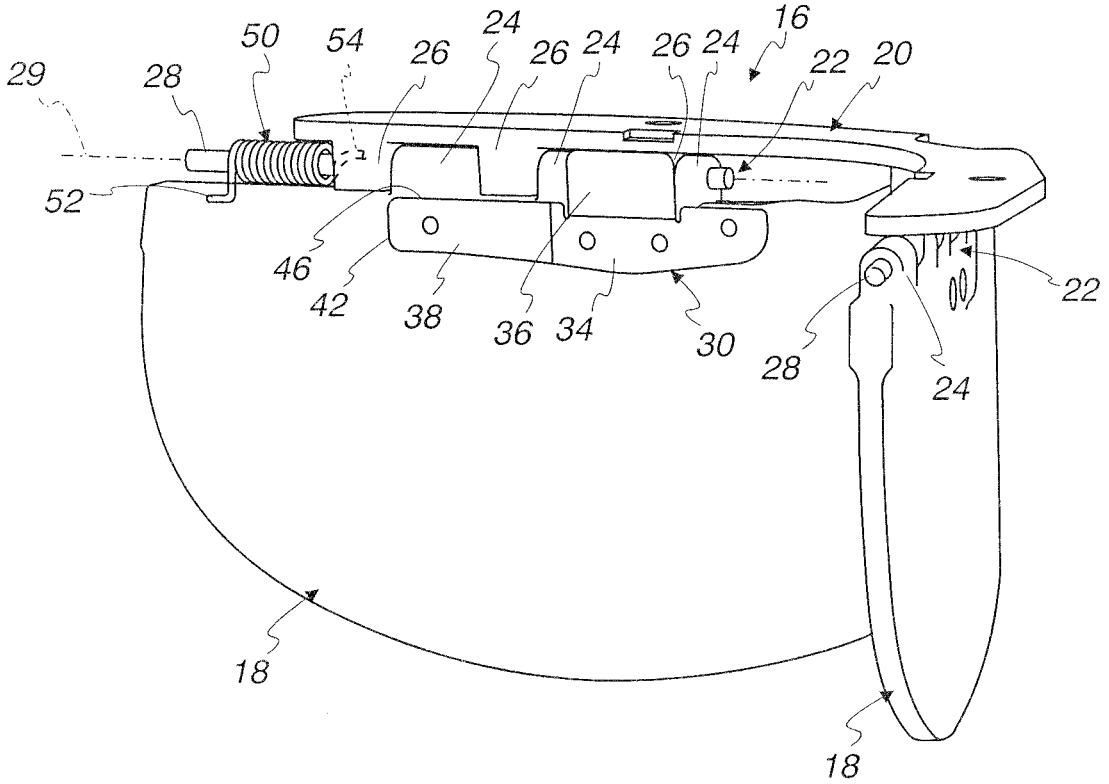
FIG. 10 is a perspective view from below and to the rear of an alternate embodiment of the eye protector of FIG. 1.

As an alternate to or in addition to, the torsion member 38, another torsion member can be provided that will urge the corresponding eye shield 18 towards the brim in the storage position. One possibility is illustrated in FIG. 10 wherein a helical torsion spring 50 has been provided and is mounted on an extension of the hinge pin 28 that is exposed by eliminating one of the bosses 24 from the eye shield 18. The helical torsion spring 50 has a leg 52 at one end of the torsion spring 50 engaging the eye shield 18 at a location spaced from the spring bracket 30, and a leg 54 (shown in phantom) on the opposite end of the helical spring 50 engaging the mount bracket 20 to transmit a torque between the bracket 20 and the eye shield 18 that urges the eye shield 18 towards the brim 14 in the storage position. While one particular construction is shown for the helical torsion spring 50, it should be understood that any suitable construction can be used, the details of which will be highly dependent upon the requirements of each application. It should also be understood that the helical torsion spring can be used in connection with a spring bracket 30 having the torsion member 38, or, in some applications, can be used with a spring bracket 30 that does not include a torsion member 38. In this regard, the extension of the bracket 30 that forms the torsion member 38 can still be included so as to provide additional support for the eye shield 18, but the twist of the distal end 42 relative to the base 40 can be eliminated.

The invention claimed is:

1. An eye protector mountable to a protective helmet for use by a firefighter or other emergency worker, the protective helmet having a brim, the eye protector comprising:

a mount bracket mounted to the brim;

an eye shield movable between a storage position extending along the brim and a usage position extending downward from the brim to shield the eye of a wearer;

a hinge to connect the eye shield to the mount bracket for movement between the storage and usage positions;

a spring engaged with the eye shield and the mount bracket to resist movement of the eye shield from the storage position and from the usage position; and at least one torsion member having a first end engaged with the eye shield at a first location and a second end engaged with the eye shield at a second location spaced from the first location, the first and second ends being twisted by a desired amount relative to each other with the at least one torsion member in an unrestrained state, the at least one torsion member being subjected to a torsion force by twisting of the at least one torsion member from the unrestrained state by the engagement at the first and second locations, the torsion force generating a reaction force on the eye shield at the second location that urges the eye shield toward the brim in the storage position.

2. The eye protector of claim 1 wherein the spring is a cantilevered spring extending from a spring bracket fixed to the eye shield,

3. The eye protector of claim 2 wherein the mount bracket comprises a spring engaging boss, the cantilevered spring engaged with the boss with the eye shield in both the usage position and the storage position to resist movement of the eye shield from the positions.

4. An eye protector mountable to a protective helmet for use by a firefighter or other emergency worker, the protective helmet having a brim, the eye protector comprising:

a mount bracket mounted to the brim;

an eye shield movable between a storage position extending along the brim and a usage position extending downward from the brim to shield the eye of a wearer;

a hinge to connect the eye shield to the mount bracket for movement between the storage and usage positions:

a spring engaged with the eye shield and the mount bracket to resist movement of the eye shield from the storage position and from the usage position;

at least one torsion member engaged with the eye shield at a location spaced from the spring, the at least one torsion member applying a force to the eye shield that urges the eye shield toward the brim in the storage position; and further comprising a spring bracket fixed to the eye shield by a mount base of the spring bracket, and wherein the at least one torsion member comprises a unitary part of the spring bracket extending from the mount base of the spring bracket to a distal end.

5. The eye protector of claim 4 wherein the mount base defines a plane and the distal end is twisted relative to the plane in an unrestrained state and aligned with the plane in a restrained state with the spring bracket mounted to the eye shield.

6. The eye protector of claim 4 wherein the hinge defines a pivot axis for the eye shield and the unitary part extends from the mount base parallel to the pivot axis.

7. The eye protector of claim 6 wherein spring is a unitary part of the spring bracket and extends perpendicular to the pivot axis.

8. The eye protector of claim 4 wherein the at least one torsion member further comprises a helical torsion spring engaged between the eye shield and the mount bracket at a location spaced from the spring and the distal end.

9. An eye protector mountable to a protective helmet for use by a firefighter or other emergency worker, the protective helmet having a brim, the eye protector comprising:

a mount bracket mounted to the brim;

an eye shield movable between a storage position extending along the brim and a usage position extending downward from the brim to shield the eye of a wearer;

a hinge to connect the eye shield to the mount bracket for movement between the storage and usage positions; and a spring bracket fixed to the eye shield and comprising a spring engaged with the mount bracket to resist movement of the eye shield from the storage position and from the usage position; and a torsion member having a first end engaged with the eye shield at a first location and a second end engaged with the eye shield at a second location spaced from the first location, the first and second ends being twisted by a desired amount relative to each other with the at least one torsion member in an unrestrained state, the torsion member being subjected to a torsion force by twisting of the torsion member from the unrestrained state by the engagement at the first and second locations, the torsion force generating a reaction force on the eye shield at the second location that urges the eye shield toward the brim in the storage position.

10. The eye protector of claim 9 wherein the spring is a cantilevered spring extending from the spring bracket.

11. An eye protector mountable to a protective helmet for use by a firefighter or other emergency worker, the protective helmet having a brim, the eye protector comprising:

a mount bracket mounted to the brim;

an eye shield movable between a storage position extending along the brim and a usage position extending downward from the brim to shield the eye of a wearer;

a hinge to connect the eye shield to the mount bracket for movement between the storage and usage positions; and a spring bracket fixed to the eye shield and comprising a spring engaged with the mount bracket to resist movement of the eye shield from the storage position and from the usage position; and a torsion member engaged with the eye shield at a location spaced from the spring, the torsion member applying a force to the eye shield that urges the eye shield toward the brim in the storage position, wherein the torsion member is a unitary part of the spring bracket extending from a mount base of the spring bracket to a distal end.

12. The eye protector of claim 11 wherein the mount base defines a plane and the distal end is twisted relative to the plane in an unrestrained state and aligned with the plane in a restrained state with the spring bracket mounted to the eye shield.

13. The eye protector of claim 12 wherein the hinge defines a pivot axis for the eye shield and the torsion member extends from the mount base parallel to the pivot axis.

14. An eye protector mountable to a protective helmet for use by a firefighter or other emergency worker, the protective helmet having a brim, the eye protector comprising:

a mount bracket mounted to the brim;

an eye shield movable between a storage position extending along the brim and a usage position extending downward from the brim to shield the eye of a wearer;

a hinge to connect the eye shield to the mount bracket for movement between the storage and usage positions;

a spring bracket fixed to the eye shield and comprising a spring engaged with the mount bracket to resist movement of the eye shield from the storage position and from the usage position;

a torsion member engaged with the eye shield at a location spaced from the spring, the torsion member applying a force to the eye shield that urges the eye shield toward the brim in the storage position, and another torsion member engaged between the eye shield and the mount bracket at a location spaced from the spring bracket to apply a force to the eye shield that urges the eye shield toward the brim in the storage position.

15. An eye protector mountable to a protective helmet for use by a firefighter or other emergency worker, the protective helmet having a brim, the eye protector comprising:

a mount bracket mounted to the brim;

an eye shield movable between a storage position extending along the brim and a usage position extending downward from the brim to shield the eye of a wearer;

a hinge to connect the eye shield to the mount bracket for movement between the storage and usage positions;

a spring engaged with the eye shield and the mount bracket to resist movement of the eye shield from the storage position and from the usage position;

a torsion member engaged with the eye shield at a location spaced from the spring, the torsion member comprising a helical torsion spring applying a force to the eye shield that urges the eye shield toward the brim in the storage position; and further comprising another torsion member engaged between the eye shield and the mount bracket at a location between the springs to apply a force to the eye shield that urges the eye shield toward the brim in the storage position.

16. The eye protector of claim 15 wherein the helical torsion spring is mounted on a pin extending from the hinge.

17. The eye protector of claim 15 wherein the helical torsion spring comprises a first leg engaged with the eye shield and a second leg engaged with the mount bracket to transmit torque between the eye shield and the bracket.

* * * * *